US011779829B2

(12) United States Patent
Wu

(10) Patent No.: US 11,779,829 B2
(45) Date of Patent: Oct. 10, 2023

(54) SKATEBOARD

(71) Applicant: Chun Feng Wu, New Taipei (TW)

(72) Inventor: Chun Feng Wu, New Taipei (TW)

( * ) Notice: Subject to any disclaimer, the term of this patent is extended or adjusted under 35 U.S.C. 154(b) by 0 days.

(21) Appl. No.: 17/564,128

(22) Filed: Dec. 28, 2021

(65) Prior Publication Data

US 2022/0203212 A1 Jun. 30, 2022

(30) Foreign Application Priority Data

Dec. 30, 2020 (TW) ..... 109217337

(51) Int. Cl.

| | |
|---|---|
| ***A63C 17/01*** | (2006.01) |
| ***A63C 17/24*** | (2006.01) |
| ***A63C 17/00*** | (2006.01) |
| ***A63C 17/22*** | (2006.01) |
| ***A63C 17/26*** | (2006.01) |

(52) U.S. Cl.

CPC ..... *A63C 17/011* (2013.01); *A63C 17/0046* (2013.01); *A63C 17/015* (2013.01); *A63C 17/226* (2013.01); *A63C 17/24* (2013.01); *A63C 17/262* (2013.01); *A63C 2203/20* (2013.01); *A63C 2203/24* (2013.01)

(58) Field of Classification Search

CPC ..... A63C 17/011; A63C 17/0046; A63C 17/0033; A63C 17/0066; A63C 17/0093; A63C 17/014; A63C 17/226; A63C 17/262

See application file for complete search history.

(56) References Cited

U.S. PATENT DOCUMENTS

| | | | | |
|---|---|---|---|---|
| 6,206,389 | B1 * | 3/2001 | Yagi | A63C 17/015 280/87.042 |
| 9,186,570 | B1 * | 11/2015 | Wells | A63C 17/0033 |
| 10,160,503 | B1 * | 12/2018 | Zheng | A63C 17/015 |
| 11,478,693 | B2 * | 10/2022 | Huang | A63C 17/0033 |
| 2002/0067015 | A1 * | 6/2002 | Tierney | A63C 17/01 280/87.042 |
| 2004/0239065 | A1 * | 12/2004 | Smith | A63C 17/06 280/87.042 |
| 2009/0200764 | A1 * | 8/2009 | Jang | A63C 17/015 280/87.042 |
| 2011/0272903 | A1 * | 11/2011 | Lewis | A63C 17/24 29/401.1 |

(Continued)

*Primary Examiner* — Brian L Swenson
(74) *Attorney, Agent, or Firm* — Che Yang Chen

(57) ABSTRACT

A skateboard includes a deck, at least a front wheel set and a rear wheel set. The front wheel set, which is arranged at a bottom of the deck at a position close to a front end thereof, includes at least one rigid and rotatable front wheel frame and at least two front wheels. The rear wheel set, which is arranged at a bottom of the deck at a position close to the rear end thereof, includes at least one rigid and non-rotatable rear wheel frame and at least two rear wheels. The outer side of the wheel is circular or arc-shaped. The structure of the skateboard allows the user to change a center of gravity and to lift the sides of the board with foot, so as to only rely on the outer arc of the left or right front and rear wheels to slide, while the rotatable front wheel frame in the left or right side may still be utilized for rotating in the forward direction, which allows a skateboard experience of forward or changing the travelling direction.

4 Claims, 5 Drawing Sheets

1

(56) References Cited

U.S. PATENT DOCUMENTS

| | | | | |
|---|---|---|---|---|
| 2013/0026728 | A1* | 1/2013 | Genov | A63C 17/24<br>280/87.042 |
| 2018/0304143 | A1* | 10/2018 | Molinary | A63C 17/012 |
| 2019/0015729 | A1* | 1/2019 | Sullivan | A63C 17/262 |
| 2019/0217915 | A1* | 7/2019 | Clos | B62K 21/10 |
| 2019/0381390 | A1* | 12/2019 | Wendelschafer | A63C 17/01 |

* cited by examiner

SKATEBOARD

BACKGROUND OF THE PRESENT INVENTION

Field of Invention

The present invention relates to a skateboard technology, and more particularly, to a skateboard that converts a sliding of four wheels into a sliding on outer arcs of front and rear wheels on a left or right side thereof to accomplish moving forward and changing a direction of travel.

Description of Related Arts

The two-day weekend has been popular for decades, and the general public has paid more and more attention to leisure activities. There are enthusiasts for all kinds of sports. Among them, skateboarding is a sporting way of advocating free movement without limit to a fixed form, and it can create more different kinds of fun. Therefore, it has become one of the sports that many people like to play in recent years.

The conventional skateboard structure (as shown in FIG. 5) is mounting a flexible T-shaped wheel frame under the board. The gameplay is usually to shift the center of gravity to press down the deck, so that the wheel frame is deformed, which consequently changes the gap between the deck and the front and rear wheels on the left or right side so as to achieve the purpose of direction change. Most of the processes of sliding forward or changing direction of travel are conducted with all the four wheels landed.

The present invention expects to provide a method that changes the traditional gameplay of skateboarding, allowing the skateboard to provide a snowboard-like experience, which differs from the old skateboarding experiences. This is what the present invention intends to actively disclose.

SUMMARY OF THE PRESENT INVENTION

An object of the present invention is to provide a skateboard, which can mainly provide the player a snowboarding-like skateboarding experience, which is different from conventional skateboarding experience, so as to add a new fun of skateboarding and enhance the overall practicality of a skateboard.

To achieve the above and other objects, the skateboard includes a deck, at least a front wheel set and at least a rear wheel set. The front wheel set, which is arranged at a bottom of the deck near a front end thereof, comprises at least one front wheel frame and at least two front wheels. The front wheel frame is a rotatable rigid structure. The rear wheel set, which is arranged at the bottom of the deck near the rear end thereof, comprises at least one rear wheel frame and at least two rear wheels. The rear wheel frame is a non-rotatable rigid structure affixed at the bottom of the deck. The outer side of the front wheel and the outer side of the rear wheel are circular or arc-shaped, so as to allow a center of gravity to be changed to tilt the deck for changing a direction thereof and to use the outer sides of the front and rear wheels on a left or right side thereof for sliding.

According to a preferred embodiment, it further includes utilizing the rotatable front wheel frame to allow the front wheels to rotate to a changed direction. The front wheel frame further includes a left front wheel frame and a right front wheel frame that are rotatable. It may cooperate with the rotatable left or right front wheel frame to allow the front wheel to rotate in a changed direction. At least one of the front wheel set and the rear wheel set further comprises a shaft, and the front wheel set or the rear wheel set may further comprise a motor respectively arranged thereon, wherein the motor can be installed in a wheel valley or driving the shaft through a belt. The deck may further include a control circuit board and/or a gravity sensing device and/or a battery, arranged at the bottom, top or inside thereof. The front wheel frame and the rear wheel frame may also include a shock absorber mounted thereon. A shoe holder is adapted to be mounted on the surface of the deck near the front and rear ends. The shoe holder includes a strap shoe cover or a step-in shoe cover, but is not limited to the two.

DETAILED DESCRIPTION OF THE PREFERRED EMBODIMENT

Figure 1:
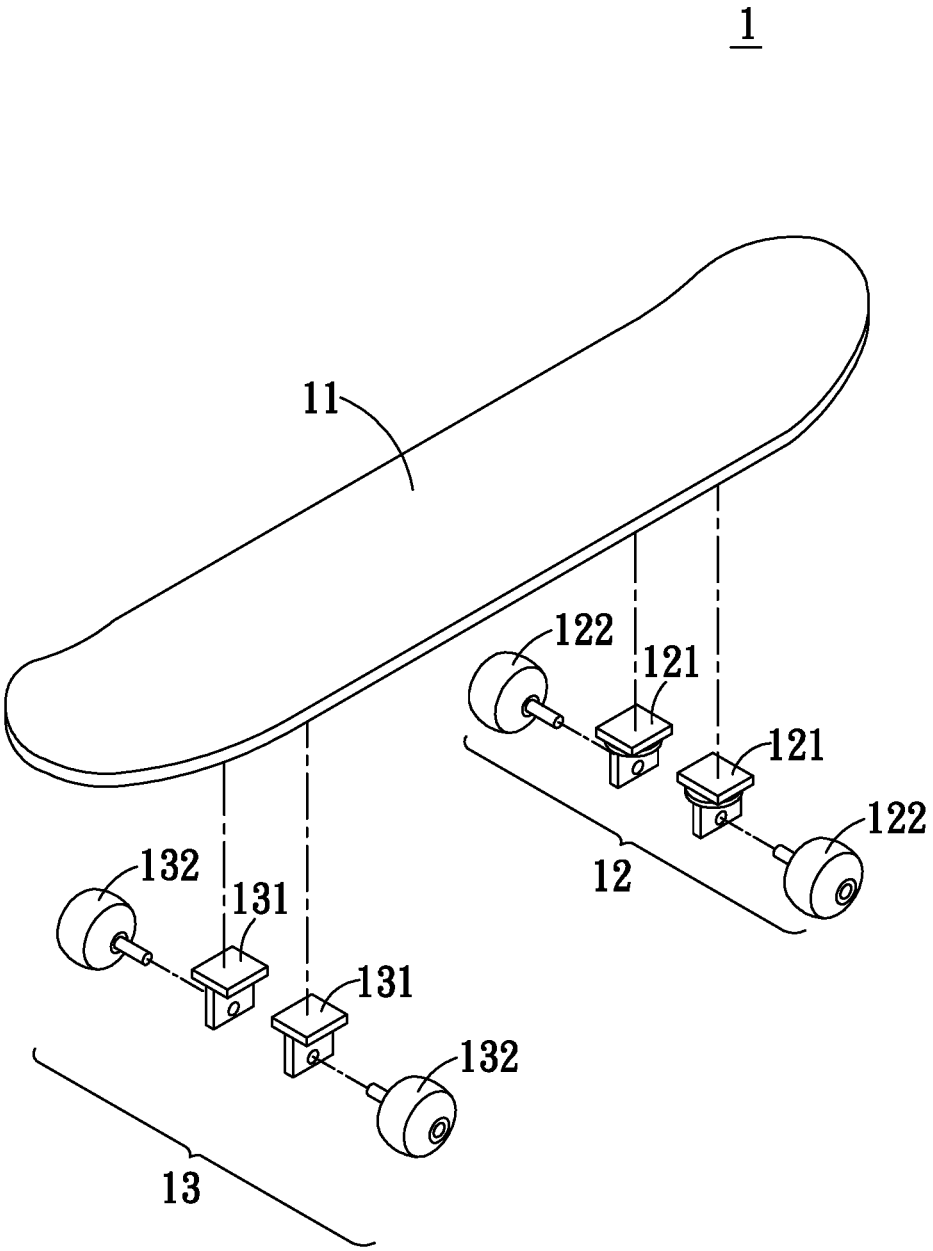
FIG. 1 is an exploded view of a skateboard according to a first preferred embodiment of the present invention.

Other advantages and efficacy of the present invention will be readily apparent to those skilled in the art from the following specific and detailed description of embodiments of the present invention.

The embodiments of the present invention will be illustrated below with the figures, and it should be noted that the figures are merely illustrative of the principles of the present invention and are merely illustrative of the principles of the present invention and are not drawn to the exact quantities, shapes, and sizes of the elements. The forms, quantities, and rations of the elements in actual implementations of the present invention shall not be limited by the figures, but to meet the actual needs instead. In addition, in order to simplify the drawings, some conventional structures and elements will be drawn in a simple schematic manner in the drawings, and repeated elements may be represented by the same numbers.

Figure 2:
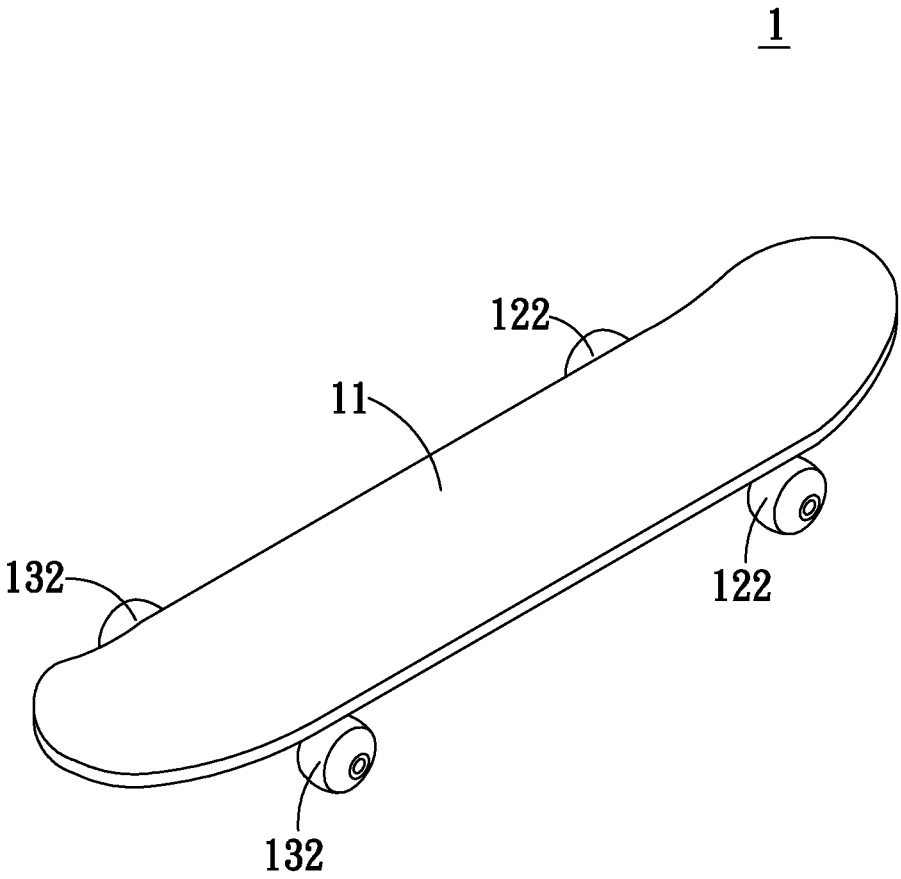
FIG. 2 is a perspective view of the assembly of the skateboard according to the above first preferred embodiment of the present invention.

Referring to FIGS. 1-2, an exploded view and a perspective assembly view of the skateboard according to a first preferred embodiment of the present invention are illustrated respectively. As illustrated in the figures, the present invention provides a skateboard 1, which comprises a deck 11, a front wheel set 12, and a rear wheel set 13. The front wheel set 12, which is arranged at a bottom of the deck 11 near a front end thereof, comprises a front wheel frame 121 and a front wheel 122 respectively provided on left and right sides thereof. The front wheel frame 121 is a rigid structure and is rotatable. The rear wheel set 13, which is arranged at the bottom of the deck 11 near a rear end thereof, comprises a rear wheel frame 131 and a rear wheel 132 respectively provided on the left and right sides thereof. The rear wheel frame 131 is a rigid structure affixed to the bottom of the deck 11, and the rear wheel frame 131 is not rotatable. The design of the rigid structure of the front wheel frame 121 and the rear wheel frame 131 can be utilized as fulcrum, allowing the user's body to move a center of gravity relative to the fulcrum of the front wheel 122 and the rear wheel 132 on the left side or the front wheel 122 and the rear wheel 132 on the right side and to exert force to the outside of the deck 11 to lift and tilt the other side of the deck 11 up. The outer side of the front wheel 122 and the outer side of the rear wheel 132 are circular or arc-shaped, which facilitate the user to tilt the deck 11 when changing a direction through utilizing the wheel frame as a fulcrum to change the center of gravity and exert the force to the outer side of the deck 11, and to use only the outside of the front and rear wheels on the left or right side to slide.

According to the first preferred embodiment, it further includes a rotatable front wheel frame 121 that allows the front wheels 122 to rotate to a changed direction. The front wheel frame 121 further includes a left front wheel frame 121 and a right front wheel frame 121 that are rotatable. The front wheels 122 cooperate with the rotatable left or right front wheel frame 121 allowing the front wheels 122 to rotate in the changed direction. The front wheel set 12 may comprise a shaft and/or a motor if appropriate, and the rear wheel set 13 may also comprise a shaft and/or a motor if appropriate. In addition, the deck 11 comprises a control circuit board and/or gravity sensing device and/or battery installed at the bottom, top or inside thereof. According to other embodiments, the front wheel frame 121 and the rear wheel frame 131 may further comprise a shock absorber mounted thereon.

With the above structure, the front wheel set 12 and the rear wheel set 13 are directly positioned and affixed at the bottom of the deck 11 or inside the deck 11 near the front and rear ends through various methods. The front wheel motor or the rear wheel motor can be installed in the wheel valley or driving the shaft through a belt. The control circuit board and/or gravity sensing device and/or battery can be installed at the bottom, top or inside the deck. Then the overall structure can be assembled. After the completion of the assembling, the front wheel 122 and the rear wheel 132 are affixed under the deck 11, and the rigid and rotatable front wheel frame 121 and the rigid and non-rotatable rear wheel frame 131 affix the front wheels 122, the rear wheels 132, and the deck 11. In this way, these four of the front wheels 122 and the rear wheels 132 can be utilized to slide during actual use. When the user wants to change the direction, the user can use the wheel frame fulcrum to change the center of gravity so as to apply a force to the outer side of the deck 11 to lift and tilt the deck 11 up, so that the front wheels 122 and rear wheels 132 on a single side of the left or right side can be utilized to slide. Meanwhile, it can also cooperate with the rotatable front wheel frame 121 to rotate the front wheel 122 in a changed direction to proceed or change the direction of travel, so that the skateboard is capable of providing a snowboard-like experience (as illustrated in FIGS. 4A and 4B).

Figure 3:
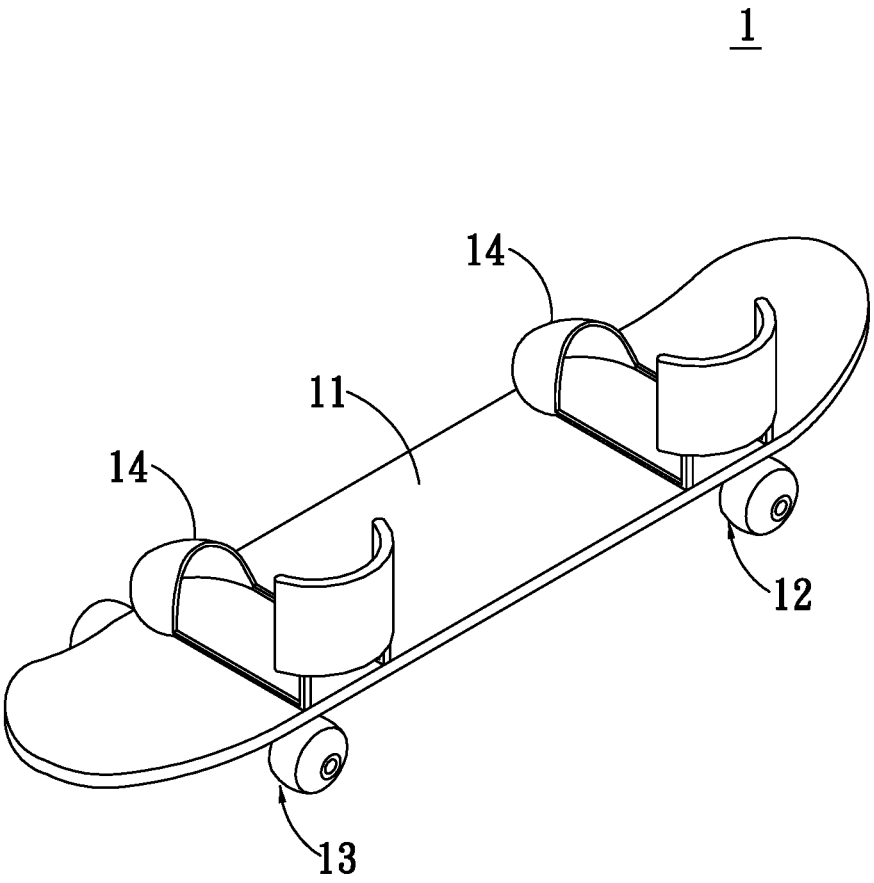
FIG. 3 is a perspective view of the assembly of the skateboard according to a second preferred embodiment of the present invention.

Referring to FIG. 3, a perspective view of the assembling of the skateboard structure according to a second preferred embodiment of the present invention is illustrated. As illustrated in the figure, like the first embodiment, the second embodiment also provides a skateboard 1, which comprises a deck 11, a front wheel set 12, and a rear wheel set 13. The difference is that the surface of the deck 11 comprises a shoe holder 14 near the front and rear ends thereof. The shoe holder 14 may include a strap shoe cover or a step-in shoe cover, but is not limited to the two. With the setting of the shoe holder 14, the user can insert the shoes into the shoe holder 14 when sliding, thereby enhancing a control force for controlling the angle change of the left and right tilting of the skateboard.

Figure 4A:
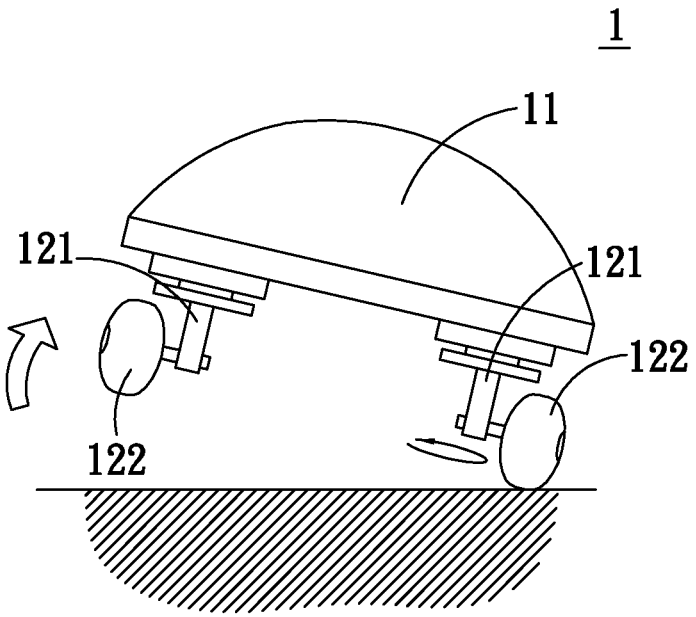
FIG. 4A is a front view of the skateboard in use according to the above first preferred embodiment of the present invention.
Figure 4B:
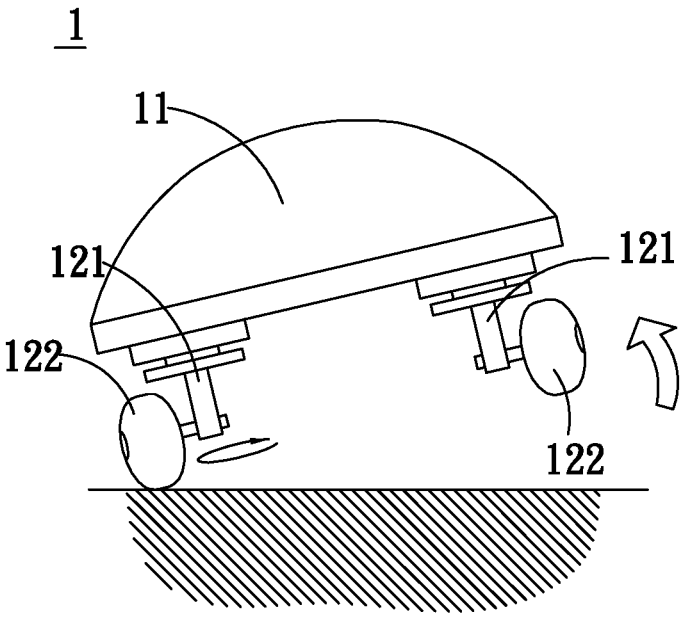
FIG. 4B is a front view of another use state of the skateboard according to the above first preferred embodiment of the present invention.
Figure 5:
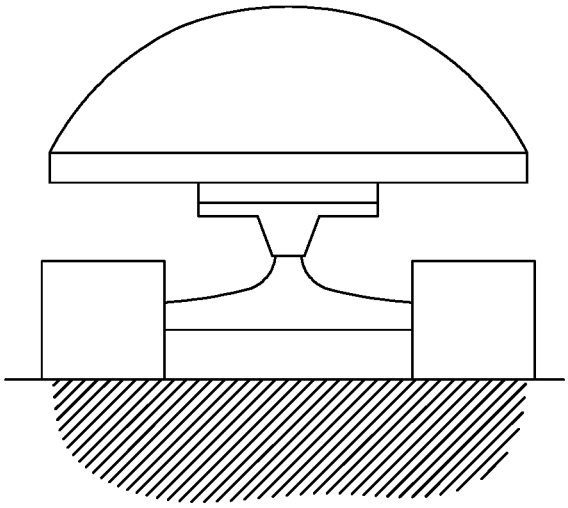
FIG. 5 is a front view of a conventional skateboard in use.

Referring to FIGS. 4A, 4B and 5, a front view of the skateboard in use according to the above preferred embodiments of the present invention, a front view of another use state, and a front view of a conventional traditional skateboard structure in use are respectively illustrated. As illustrated in FIGS. 4A and 4B, for the skateboard structure 1 of the present invention, the outer side of the front wheel 122 is a circular or an arc shape, and the outer side of the rear wheel 132 is also a circular or an arc-shaped (as shown in FIG. 1), which allows utilizing the wheel frame fulcrum to change the center of gravity and exerting a force to the outer side of the deck 11 to lift and tilt the deck 11 up for changing the direction and relying on the circular or an arc-shaped structure in the left or right outer side of the front and rear wheels for sliding. In addition to the cooperation with the rotatable front wheel frame 121, the front wheel 122 is capable of rotating to the changed direction for proceeding forward or changing the direction of travel. Unfortunately, a conventional skateboard structure, as shown in FIG. 5, mainly rely on all four of the front and rear wheels for sliding on the ground, which is unable to achieve the sliding state of the present invention.

Contrasting to conventional technology (as illustrated in FIG. 5) that uses a T-shaped flexible wheel frame and four-wheeled landing manner to slide forward or changing the direction of travel entirely, the skateboard structure of the present invention mostly utilizes the front and rear wheels of a single side of the left or right to slide (as illustrated in FIGS. 4A and 4B), which is mainly because that structure of the skateboard of the present invention provides a rigid wheel frame to serve as a fulcrum. In actual use, the four of the front wheels and the rear wheels are capable of being utilized to slide. When the travelling direction is to be changed, the wheel frame fulcrum can be utilized for changing the center of gravity and for exerting force to the outer side of the deck 11 to tilt and lift the deck 11 up, so that the outer arc of the front and rear wheels on the left or right side can be utilized for the sliding action. In addition, the cooperation of the rotatable front wheel frame allows the front wheel 122 to turn to a changed direction, such that any one of the sides can serve for proceeding or changing the direction of travel, which grants the skateboard to provide an experience similar to a snowboard and enhances the skateboarding experience and fun.

While the foregoing description and drawings have disclosed preferred embodiments of the present invention, it should be understood that various additions, modifications, and substitutions may be made to the preferred embodiments of the present invention without departing from the spirit and scope of the principles of the present invention as defined by the appended claims. One of ordinary skill in the art to which this disclosure pertains will appreciate that the present invention may be utilized with modifications in many forms, structures, arrangements, proportions, materials, elements, and components. Accordingly, the embodiments disclosed herein shall be considered as illustrative and not restrictive of the present invention. The scope of the present invention should be defined by the appended claims, and be intended to cover legal equivalents thereof, and not be limited to the previous description.

What is claimed is:

1. A skateboard, comprising:

a deck;

a front wheel set, which is arranged at a bottom of said deck at a front end thereof, comprising at least one front wheel frame and at least two front wheels, wherein said at least one front wheel frame is a rotatable rigid structure; and a rear wheel set, which is arranged at the bottom of said deck at a rear end thereof, comprising at least one rear wheel frame and at least two rear wheels, wherein said at least one rear wheel frame is a non-rotatable rigid structure affixed on the bottom of said deck, wherein an outer side of said front wheel and an outer side of said rear wheel are in a circular or arc shape, so as to allow said outer side of each of said left and right front wheels functioning as a fulcrum to change a center of gravity and exert a force to an outer side of said deck for left and right lifting and tilting said deck up while changing a direction and for sliding only with said outer sides of said left front wheel and said left rear wheel or said outer sides of said right front wheel and said right rear wheel.

2. The skateboard structure, as recited in claim 1, further comprising a pair of shoe holders provided on said deck near said front end and said rear end thereof respectively for allowing shoes of a user inserted therein while sliding for controlling an angle change of said left and right tilting of said deck.

3. The skateboard structure, as recited in claim 2, wherein each of said shoe holders includes a strap shoe cover.

4. The skateboard structure, as recited in claim 2, wherein each of said shoe holders includes a step-in shoe cover.

* * * * *